US011132982B1

(12) United States Patent
Drapkin

(10) Patent No.: US 11,132,982 B1
(45) Date of Patent: Sep. 28, 2021

(54) BASS CLARINET BODY STRAP

(71) Applicant: Michael Drapkin, Sarasota, FL (US)

(72) Inventor: Michael Drapkin, Sarasota, FL (US)

(73) Assignee: Michael Drapkin, Sarasota, FL (US)

( * ) Notice: Subject to any disclaimer, the term of this patent is extended or adjusted under 35 U.S.C. 154(b) by 0 days.

(21) Appl. No.: 17/104,854

(22) Filed: Nov. 25, 2020

(51) Int. Cl.
*G10G 5/00* (2006.01)
*G10D 9/00* (2020.01)
*G10D 7/066* (2020.01)

(52) U.S. Cl.
CPC ..... *G10G 5/005* (2013.01); *G10D 7/066* (2013.01); *G10D 9/00* (2013.01)

(58) Field of Classification Search
CPC ..... G10G 5/005; G10D 7/066; G10D 9/00
See application file for complete search history.

(56) References Cited

U.S. PATENT DOCUMENTS

2018/0211642 A1* 7/2018 Harris ..... G10D 9/047
2020/0219471 A1* 7/2020 Jancic ..... A45F 5/00
2021/0015215 A1* 1/2021 Tabor ..... G10G 5/005

* cited by examiner

*Primary Examiner* — Kimberly R Lockett

(57) ABSTRACT

The Bass Clarinet Body Strap allows a bass clarinetist to attach their body to their bass clarinet and its loop attachment point on the instrument situated above the bass clarinet thumb rest. A wide strap has one end that goes in front of the player approximately at chest level, and extends over one shoulder, across the back, down around the other side of their body coming out below the other arm, and around the front of the player's body where the two wide strap ends meet. One end of the wide strap has a lace attached that is manually passed through an opening in the other end of the wide strap and is affixed to the closed loop of a hook. This hook is then affixed to the bass clarinet loop attachment point above the thumb rest. A buckle on the strap allows for size adjustment.

4 Claims, 15 Drawing Sheets

BASS CLARINET BODY STRAP

BACKGROUND OF INVENTION

(a) Field of the Invention

The present invention relates to wearable body straps for bass clarinets.

(b) Description of the Related Art

When one hears or sees the term "clarinet," such as the instrument performed and popularized in music by jazz great Benny Goodman, they are usually referring to the Bb soprano clarinet (FIG. 1). It also refers to an instrumental family group of clarinets, which include the Bb, A, C and Eb soprano clarinets, as well as the bass clarinet (FIG. 2). These clarinets are all used in modern professional symphony orchestras.

Modern professional model clarinets are made from Grenadilla wood—a member of the rosewood family and a dense, strong, durable African blackwood that is less susceptible to cracks. Its full configuration includes a mouthpiece, reed, and ligature (a clamp that holds the reed to the mouthpiece), and the soprano clarinet weighs approximately 1 pound 13 oz., although student model clarinets use inexpensive artificial materials that may vary in weight.

When playing the soprano clarinet, the instrument is stabilized to the body through two points—with the mouth on the mouthpiece and the right thumb pressed against the clarinet on the clarinet's lower joint with a "thumb rest" (FIG. 3) that sits on the thumb between the thumb nail and the first joint on the right thumb (FIG. 4). Therefore, almost all of the weight of the instrument is transmitted through the thumb rest to the right hand, arm, and shoulder. The right thumb becomes the primary structural element supporting the clarinet weight with the mouth supplying stabilization (FIG. 1). Over time and practice, supporting this weight becomes second nature, and leaves the entire left hand and the fingers of the right hand to "play the instrument" and effortlessly press the various keys and cover the tone holes that make up the standard Boehm clarinet fingering system used in the United States with no tension. The result is a very facile instrument able to play notes with great rapidity and fluidity.

This facility can be achieved whether the performer is sitting or standing, and enables the vast majority of clarinet players—starting in late elementary school or middle school—to be able to play the instrument without the need for any additional supportive equipment.

As mentioned earlier, the bass clarinet (FIG. 2) is a standard member of the professional symphony orchestra clarinet section. First invented in its present form by Adolph Sax in 1838, it began to have parts written for it in the orchestra by major composers starting with German opera composer Giacomo Meyerbeer who featured the instrument in a big solo in the fifth act of his popular opera Les Huguenots. The bass clarinet became so prominent in the orchestra clarinet section that three entire bass clarinet excerpt books of difficult passages and solos from the repertoire were written and published by Michael Drapkin.

The bass clarinet is similar to the Bb soprano clarinet in that it is also a Bb instrument, uses the same Boehm fingering system and is also made from dense Grenadilla wood. The difference is that it sounds an entire octave lower than the soprano clarinet. Therefore, due to acoustic requirements, the bass clarinet is much larger and heavier than the soprano clarinet in order to achieve the octave lower voicing.

The hand positioning and fingering of the bass clarinet are also nearly identical to the soprano clarinet, making it relatively easy for soprano clarinetists to play the bass clarinet. There is also a thumb rest for the right-hand thumb (FIG. 5). However, bass clarinets weigh between 30-50 pounds, so the instrument cannot be held in the air as is done with the soprano clarinet, as it is too heavy, and it is usually played in the sitting position. Instead, when sitting, a "peg"—a metal rod with a rubber foot on one end—is attached to the bottom of the bass clarinet through a slip joint on the bottom joint of the bass clarinet and tightened using a large screw to hold it in place (FIG. 6). This way the height of the instrument can be adjusted according to the taste and stature of the performer, and the weight of the instrument is transmitted to the floor via the peg's rubber foot.

The bass clarinet diverges from the soprano clarinets such that the keys are larger, and the spring tension is much heavier. This additional spring tension results in the tendency for the bass clarinet to want to push away from the player when in the playing position (FIG. 7), especially since the instrument is balanced on the floor peg in a neutral position. This causes the player to have to divert some strength in the fingers to pull the instrument back towards their body. The traditional solution to this problem has been for bass clarinet manufacturers to include a "neck strap" that goes around the neck, with laces that meet at a hook that is connected to a loop attachment point permanently affixed to the instrument above the right thumb rest (FIG. 5).

While the major professional bass clarinet manufacturers in the United States (Selmer, Buffet, and Yamaha) include a generic neck strap similar to the one described in the previous paragraph as standard equipment (FIG. 8), it has severe shortcomings. Because the strap goes around the neck, it pulls downward on the neck and can create pain, discomfort, and stress on the neck, its muscles, and bones. Also, the angle of the strap generally extends upwards at a 45-degree or steeper angle (FIG. 8) from the loop attachment point on the bass clarinet to the neck, amplifying the tension to the neck and resulting in additional downward tension. This tension also makes it difficult for the bass clarinet player to disengage the mouth from the bass clarinet when not playing and to remove the hook on the neck strap from the bass clarinet when the mouth is engaged on the bass clarinet mouthpiece. Therefore, using a neck strap when playing the bass clarinet can be painful, awkward, and uncomfortable.

Since the bass clarinet, with its heavy springs and keys, tends to press away from the player (FIG. 7), a means needs to be found to counteract this force without causing undue pain and discomfort. Unlike the soprano clarinet, which is held at an angle and engages the player at only two places—the mouth and the right thumb (FIG. 1)—the weight and the heavy spring tension of the bass clarinet need to be counteracted and stabilized at four points: also through the mouth, the thumb, the floor peg and a means of counteracting the spring tension of the instrument. Like with the soprano clarinet, the bass clarinet player needs to be able to effortlessly press the various keys involved in playing the instrument with great facility and rapidity. Without a means of counteracting the bass clarinet's spring tension and stabilizing the instrument, the player will be either constantly finding the instrument to be pushing away from them or using the sides of the hand to try to stabilize the instrument, diverting their hands from being able to play effortlessly or worse—to accidently hit keys and unintentionally playing wrong notes or other errors.

In view of the disadvantages inherent in the generic bass clarinet neck straps provided by bass clarinet manufacturers and the necessity for a means of counteracting the spring tension that pushes the instrument away from the player, the present invention provides a solution to all of these problems with a bass clarinet body strap.

BRIEF SUMMARY OF THE INVENTION

In order to provide a solution to the above-mentioned limitations, there is provided a bass clarinet body strap assembly comprising: a strap having a first end and a second end, each end having an opening; a lace having two ends, one end of the lace connected to the second end of the strap; a hook tied to other end of the lace, the hook to be attached with an eye of a bass clarinet, the hook feeds through the first end of the wide strap end and is affixed to the eye of the bass clarinet; wherein the strap goes in front of a bass clarinet player at chest level and extends over shoulder and across back of the bass clarinet player, and coming out below an opposite arm, and around front of the bass clarinet player to where the first end and the second end meet.

The hook of the bass clarinet body strap assembly consists of two ends, wherein one end is a closed loop used for attachment by the lace, and another end is open so that it can hook onto the bass clarinet's eye attachment point that is built into the bass clarinet.

The bass clarinet body strap assembly further comprises an adjustment buckle that can increase or decrease the length of the strap.

The bass clarinet body strap assembly is provided with a reinforced material attached on the first end and the second end.

The bass clarinet body strap assembly thus consists of three parts.

(1) A wide strap that goes around the player's body. Starting in front of the player at the bottom of the chest where the two ends of the strap meet (FIG. 9), one end goes up over the player's shoulder (FIG. 10), across the back (FIG. 11), down to below the other arm where it comes around the front and meets the other end (FIG. 12).

(2) A lace attached to the starting end of the strap passes through the other end of the strap, pulling the two ends together, and extends a short distance from the two ends (FIG. 12) towards the bass clarinet when worn.

(3) A metal hook with one closed end and one open end, with the lace affixed to the closed end (FIG. 12). The open end of the hook can then be hooked to the loop attachment point on the bass clarinet that is situated above the thumb rest (FIG. 13).

A buckle in the strap allows for significant adjustment of the length of the strap to accommodate different body sizes and needs of different players (FIG. 14). Tightening the strap via the strap buckle pulls the bass clarinet closer when it is hooked to the strap assembly, consisting of the wide strap, lace and hook. This increases the tension between the bass clarinet and the bass clarinet player when in playing position (FIG. 15). Loosening the strap via the buckle increases the distance between the player and the bass clarinet.

This invention spreads the strap tension across the bass player's back resulting in both an extremely comfortable system, as well as pulling the bass clarinet more directly towards the player with the exact tension desired by the player instead of previous affixation systems that put all of the stress on a narrow strip at the player's neck at a steeper angle from the bass clarinet. It also neutralizes the spring tension of the bass clarinet, resulting in both a neutral hand position allowing for effortless playing but also greater stability in playing position.

Further, since the wide strap of the invention goes around the back, the player can wear a jacket or tuxedo over the entire strap except for where the two ends meet in front of the player (FIG. 15). The strap portion of the invention is also available in a variety of colors.

DETAILED DESCRIPTION OF THE INVENTION

Figure 1:
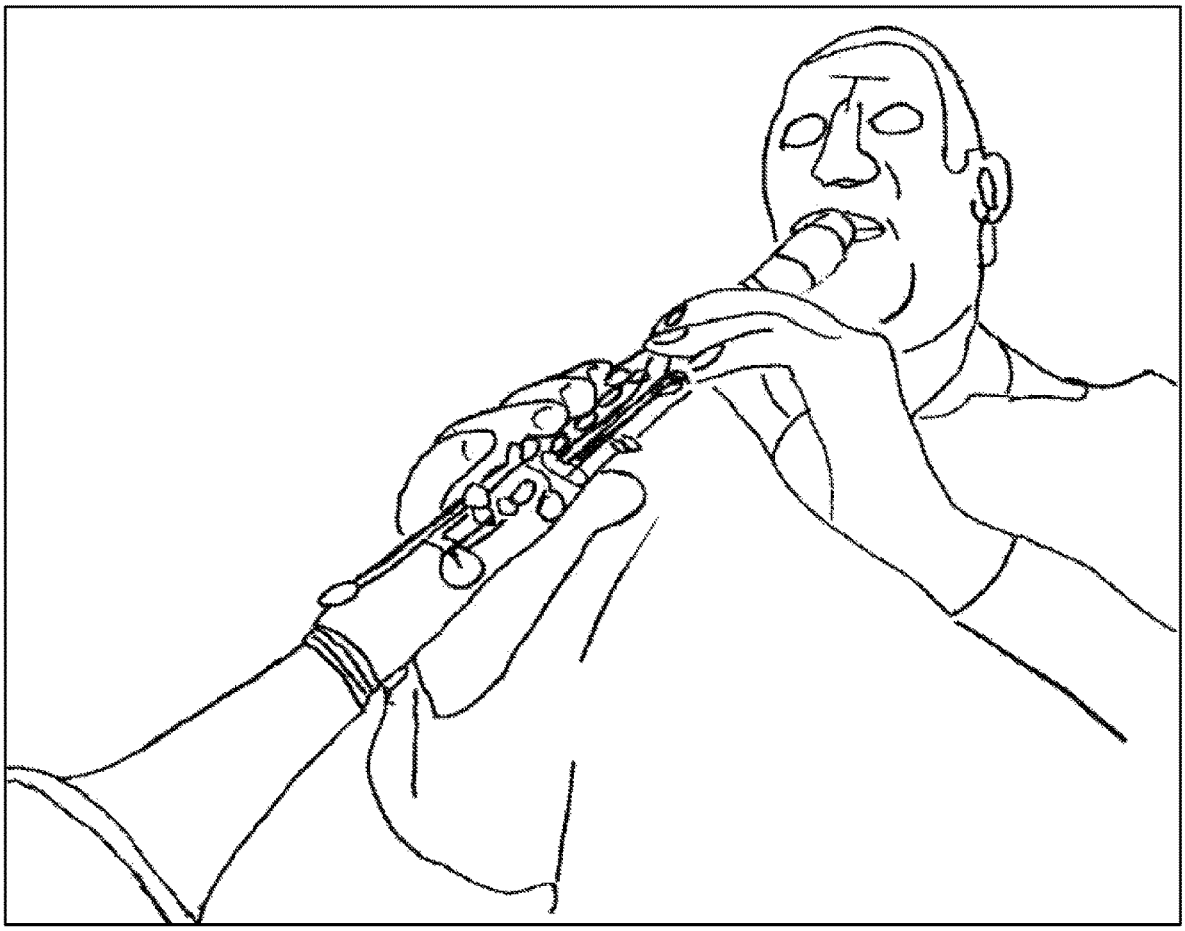
FIG. 1 illustrates a Bb soprano clarinet being held in playing position.
Figure 2:
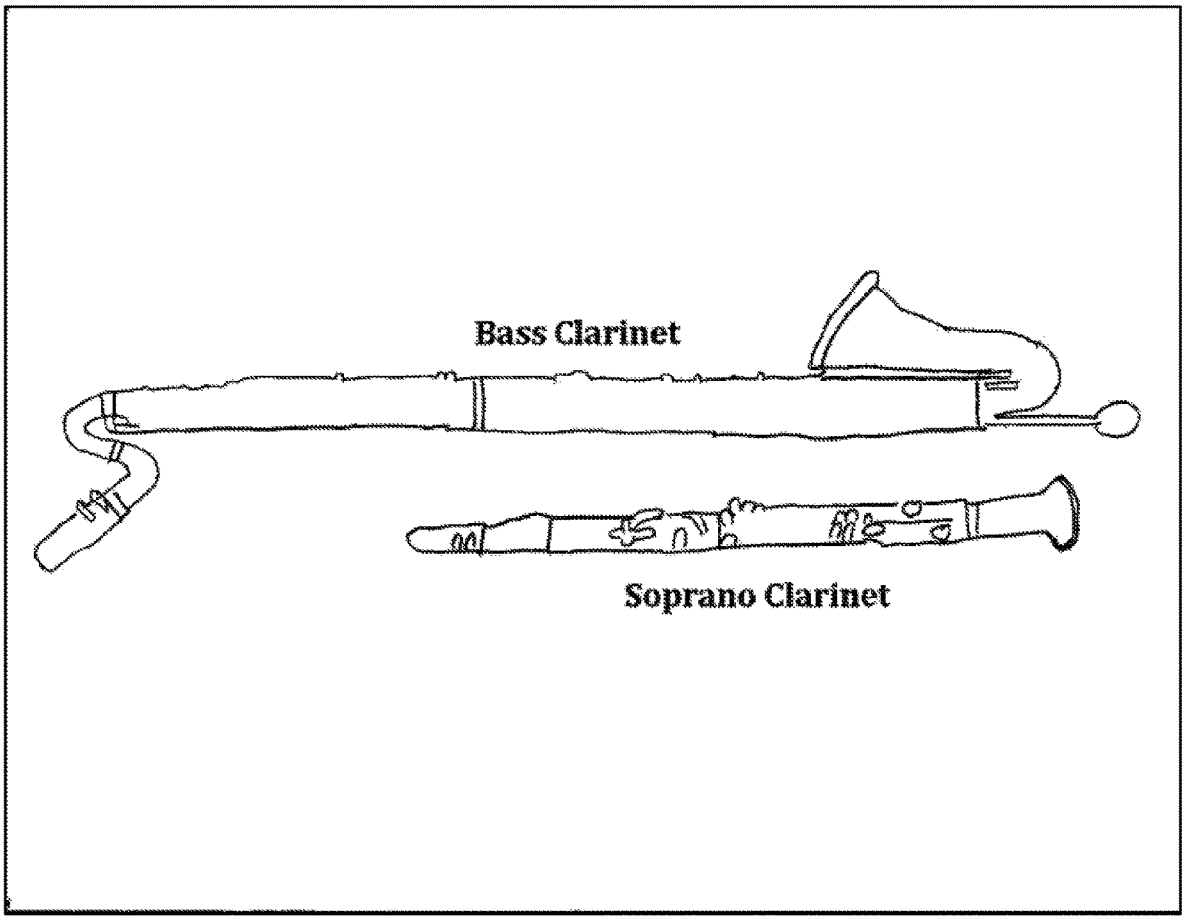
FIG. 2 illustrates view of a soprano clarinet and a bass clarinet.
Figure 3:
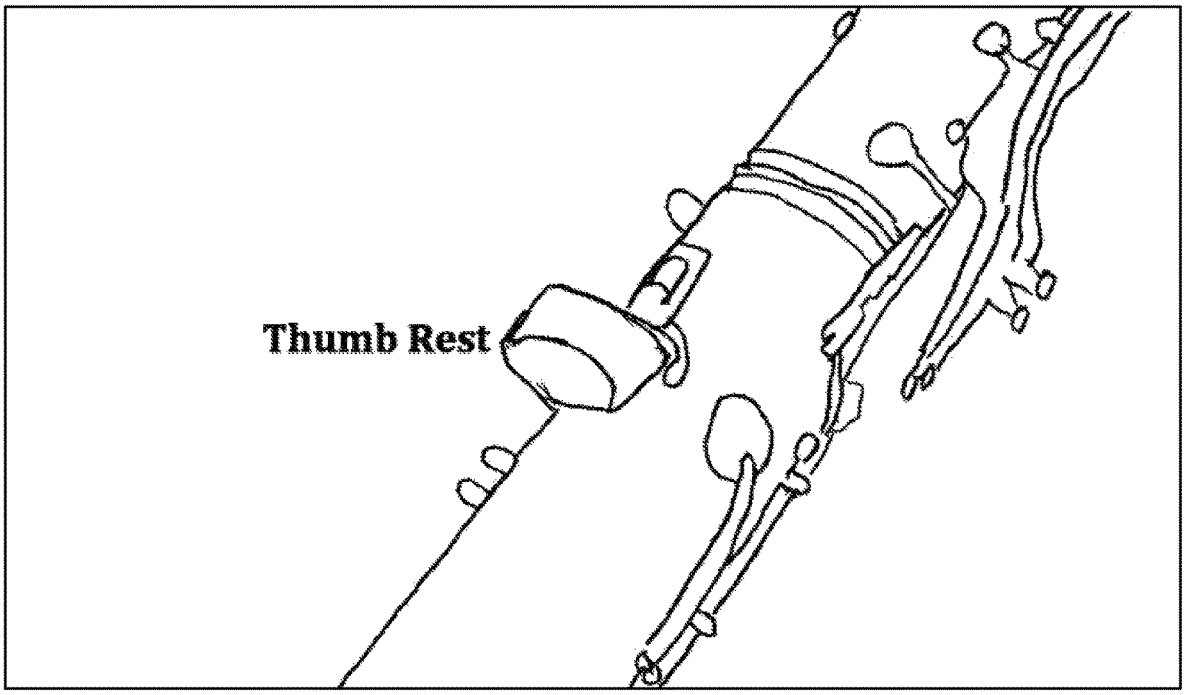
FIG. 3 illustrates a soprano clarinet thumb rest.
Figure 4:
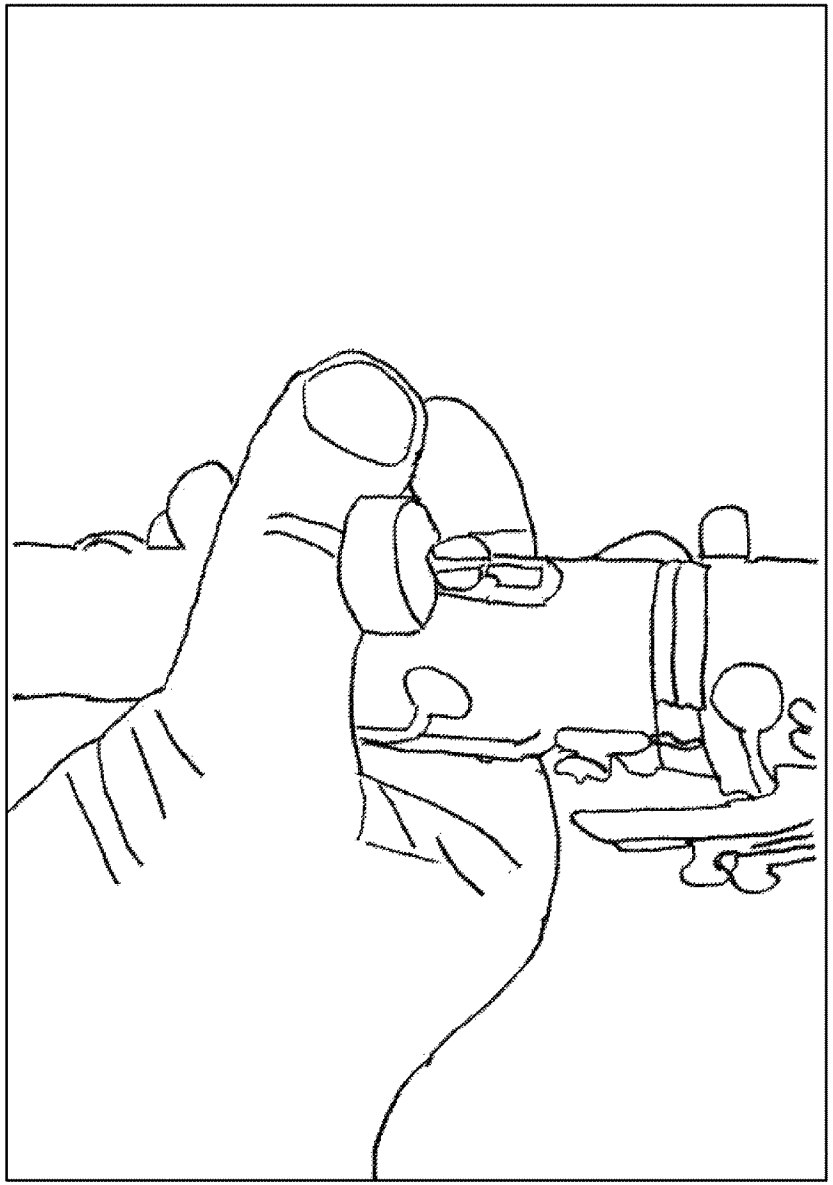
FIG. 4 illustrates a clarinet player's thumb in playing position on a soprano clarinet thumb rest.
Figure 5:
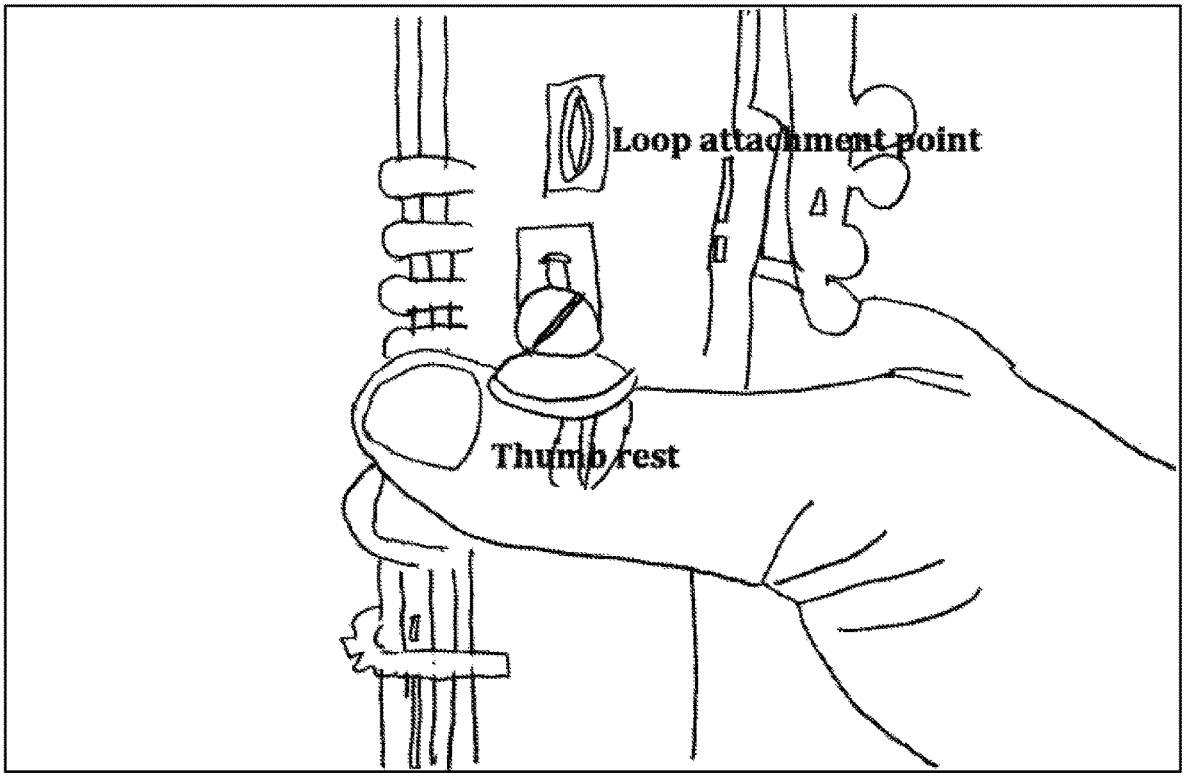
FIG. 5 illustrates a bass clarinet player's thumb in playing position on a bass clarinet thumb rest with the loop attachment point above it.
Figure 6:
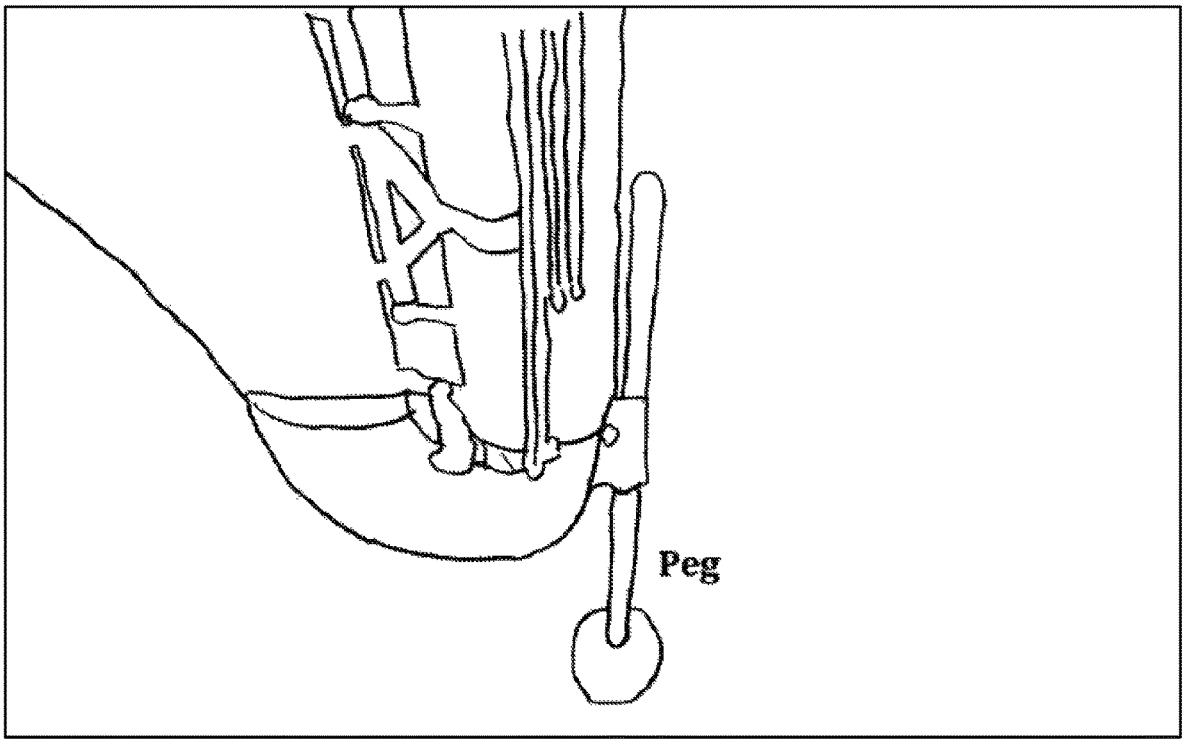
FIG. 6 illustrates a view of a bass clarinet peg.
Figure 7:
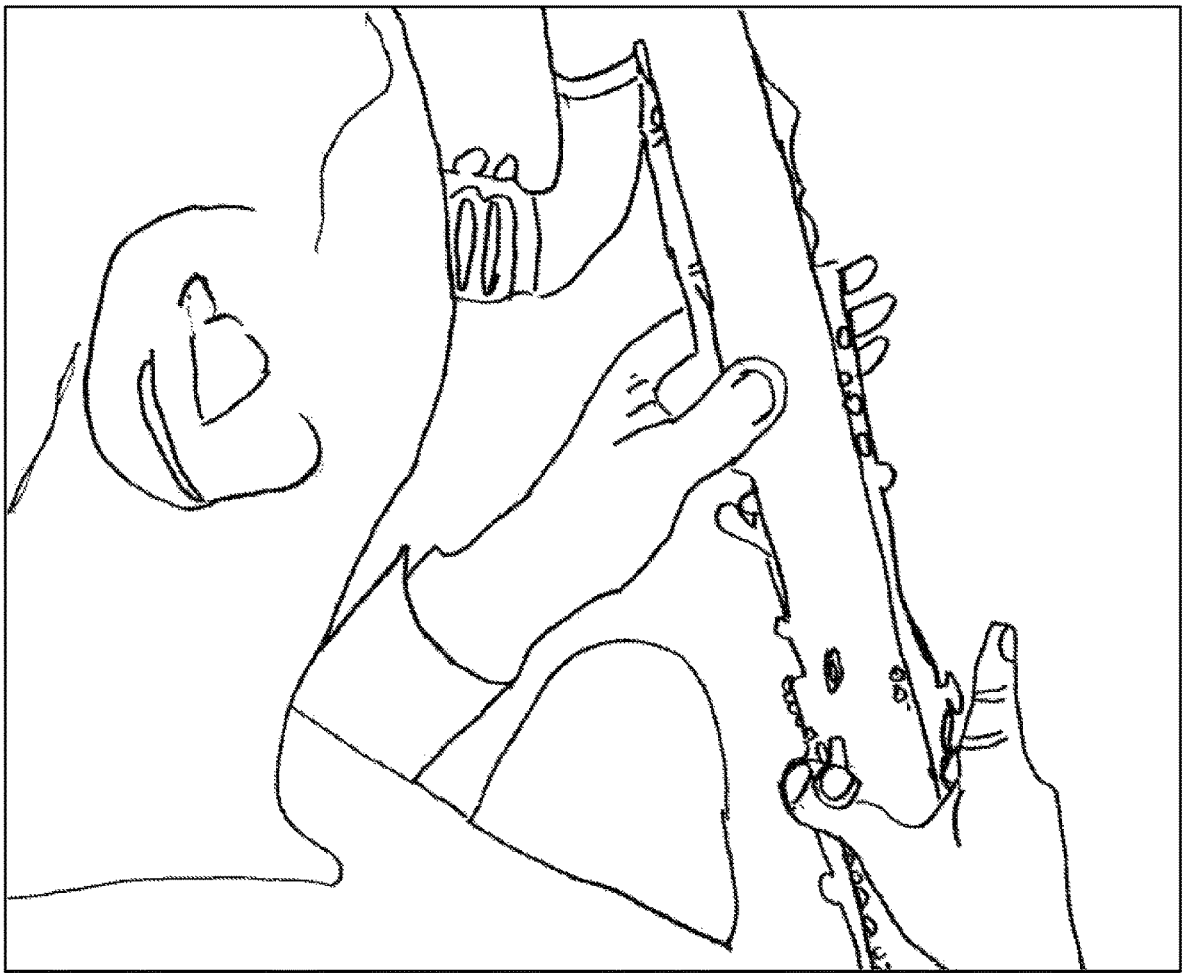
FIG. 7 illustrates a bass clarinet pushing away from the hands.
Figure 8:
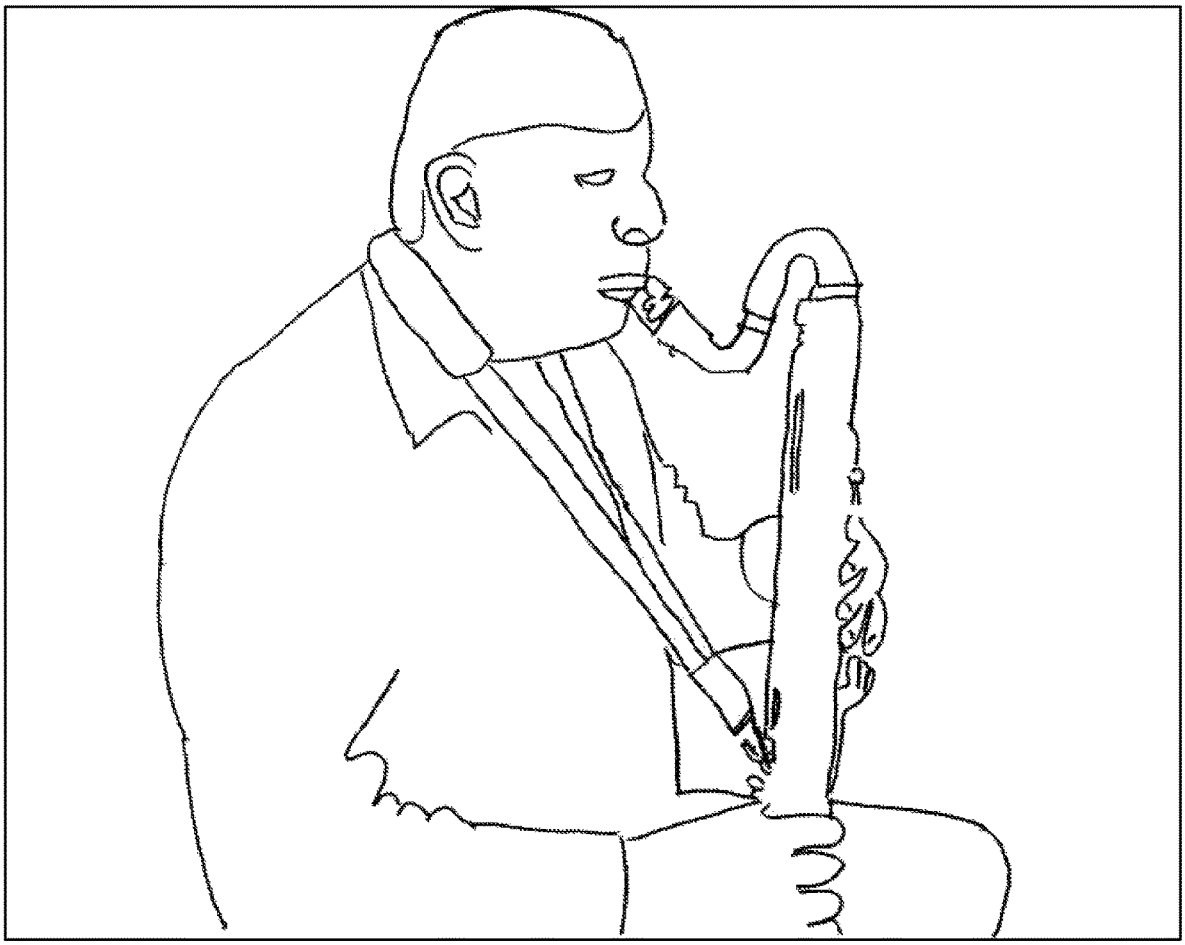
FIG. 8 illustrates a bass clarinet neck strap in playing position.
Figure 9:
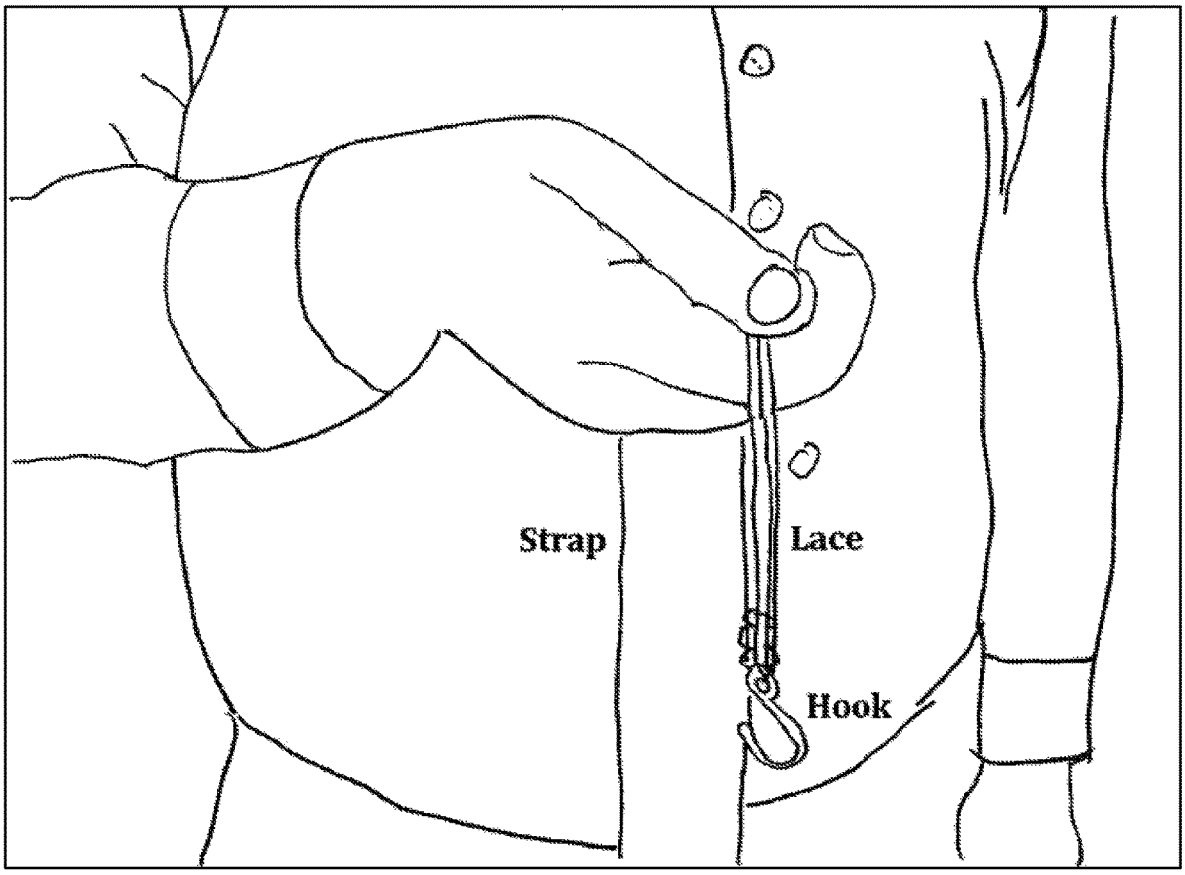
FIG. 9 illustrates a bass clarinet body strap being according to an embodiment of the present invention.
Figure 10:
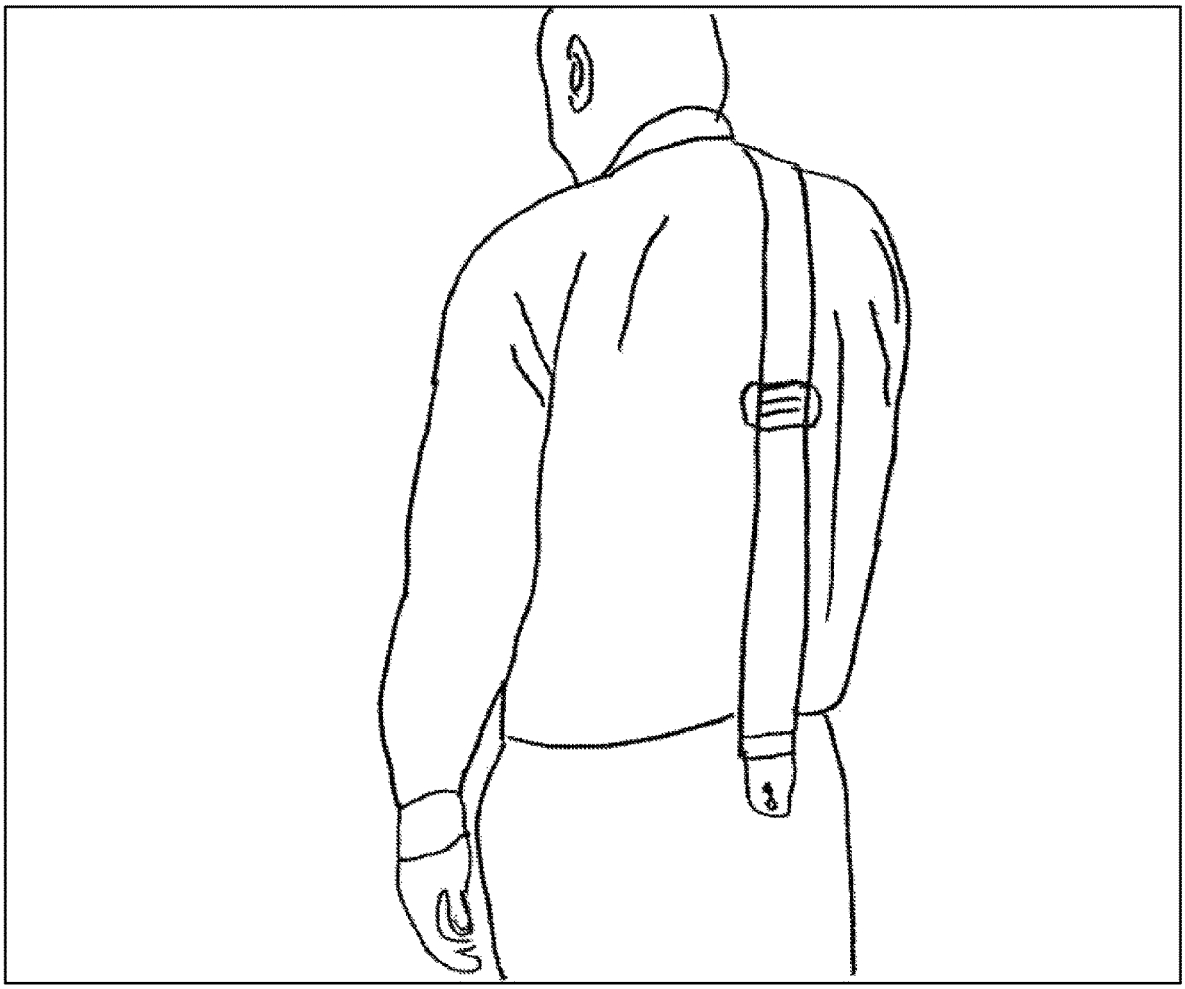
FIG. 10 illustrates the bass clarinet body strap extending over the player's shoulder, according to an embodiment of the present invention.
Figure 11:
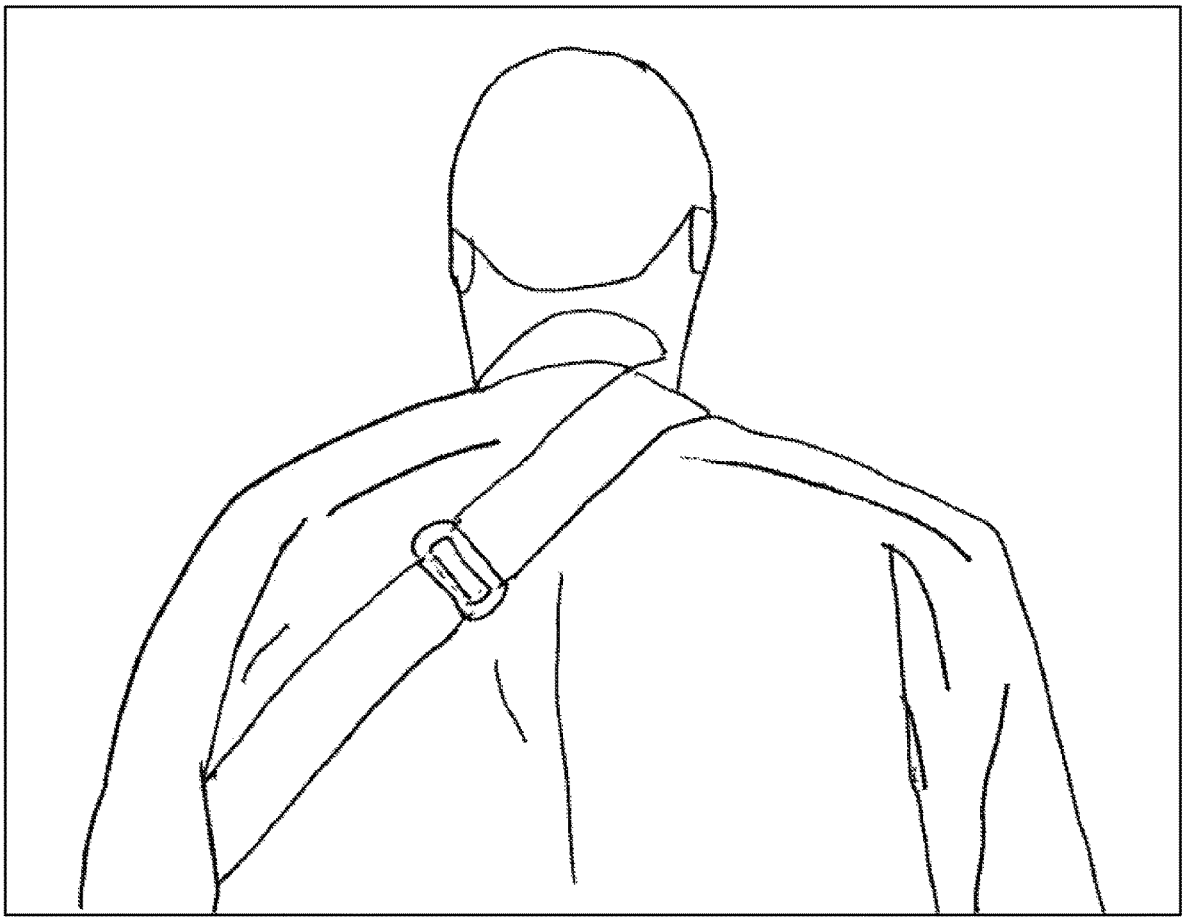
FIG. 11 illustrates bass clarinet body strap, according to an embodiment of the present invention, going around the back of the player.
Figure 12:
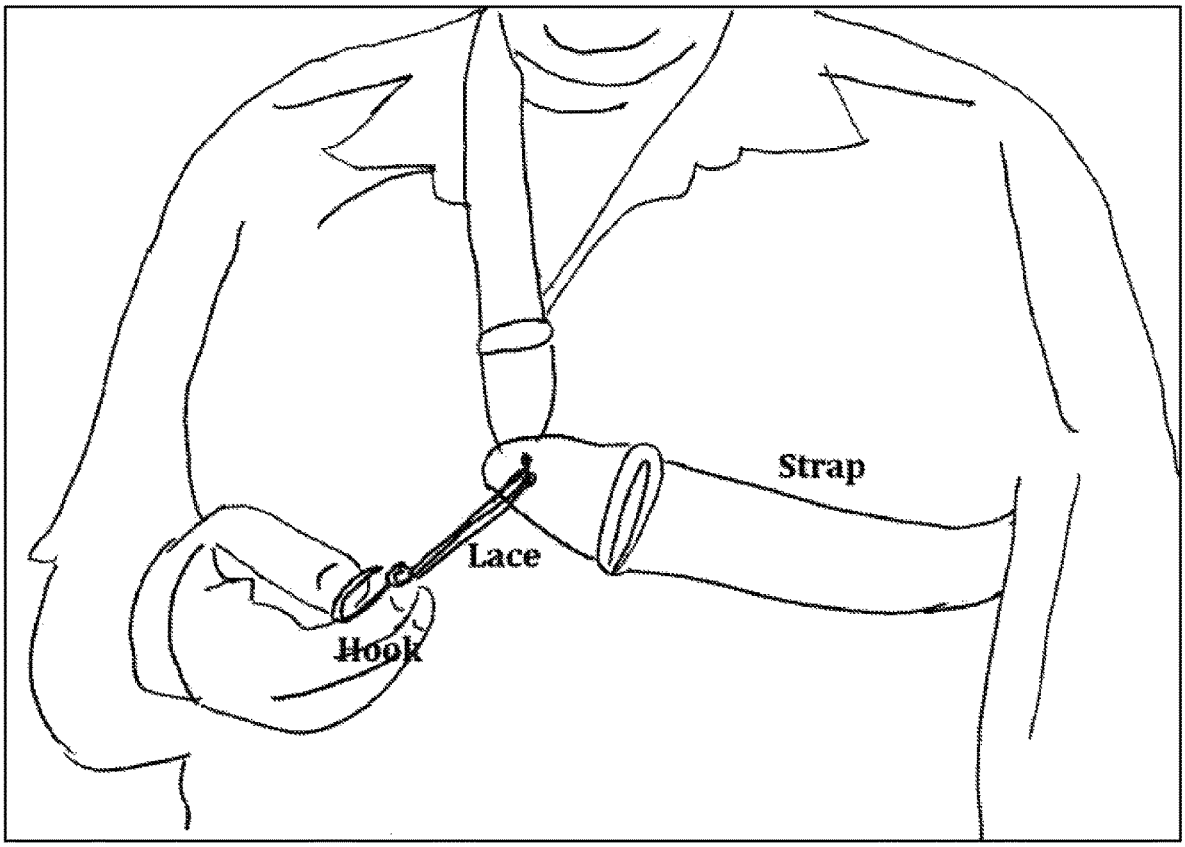
FIG. 12 illustrates the bass clarinet body strap ends together in front with the lace/hook assembly extended through the far end of the strap, according to an embodiment of the present invention.
Figure 13:
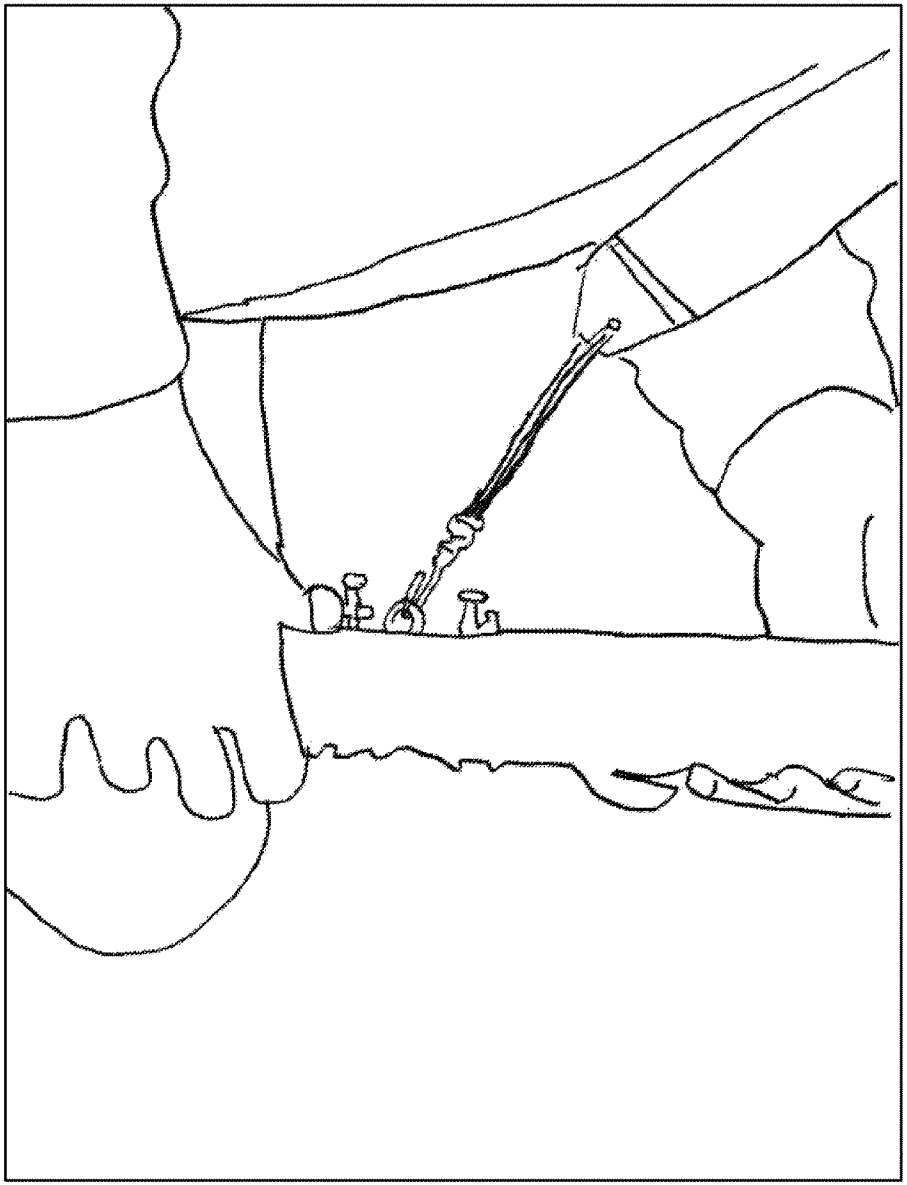
FIG. 13 illustrates the bass clarinet body strap hooked to the bass clarinet at the loop attachment point, according to an embodiment of the present invention.
Figure 14:
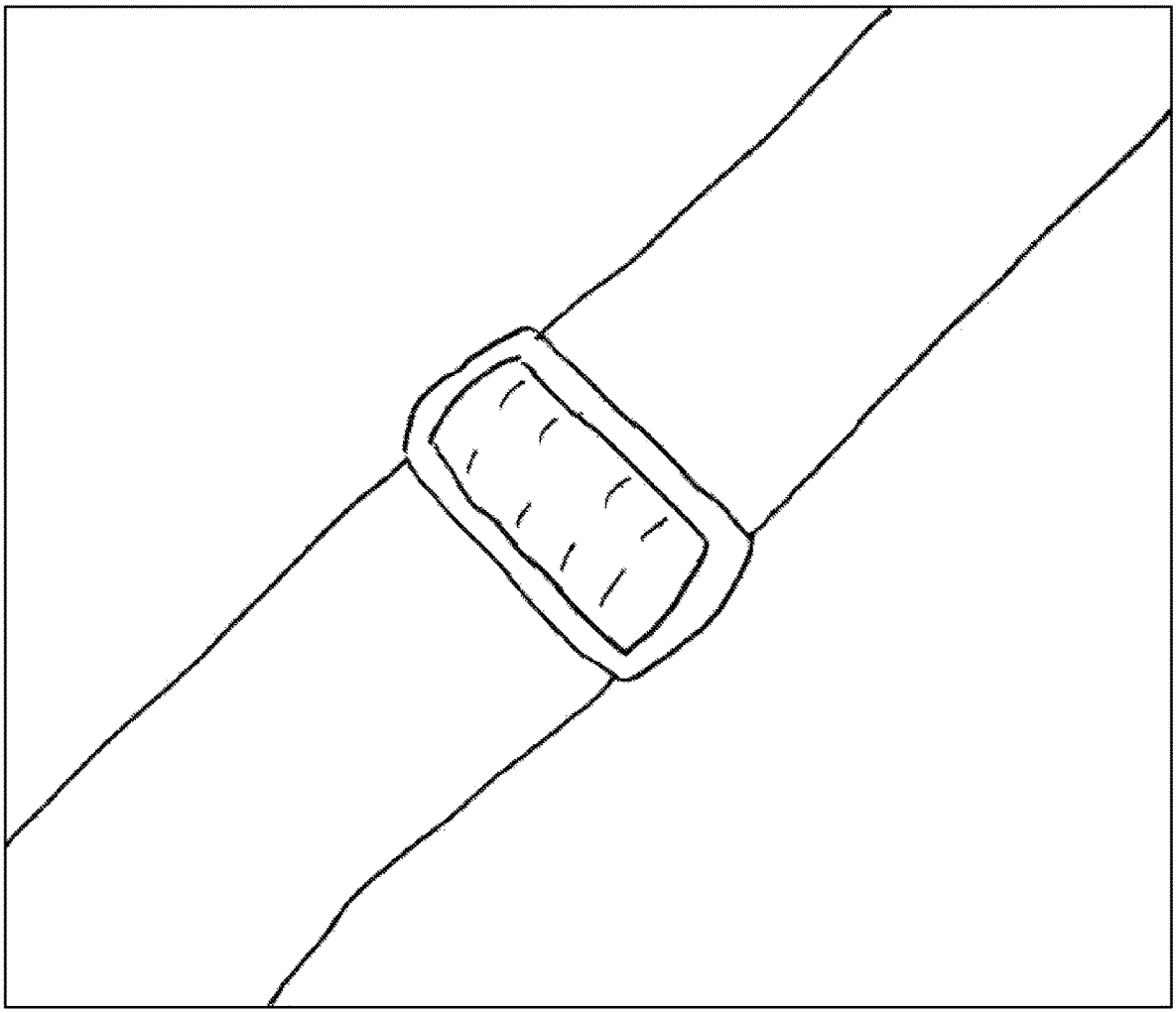
FIG. 14 illustrates the strap adjustment buckle according to an embodiment of the present invention.
Figure 15:
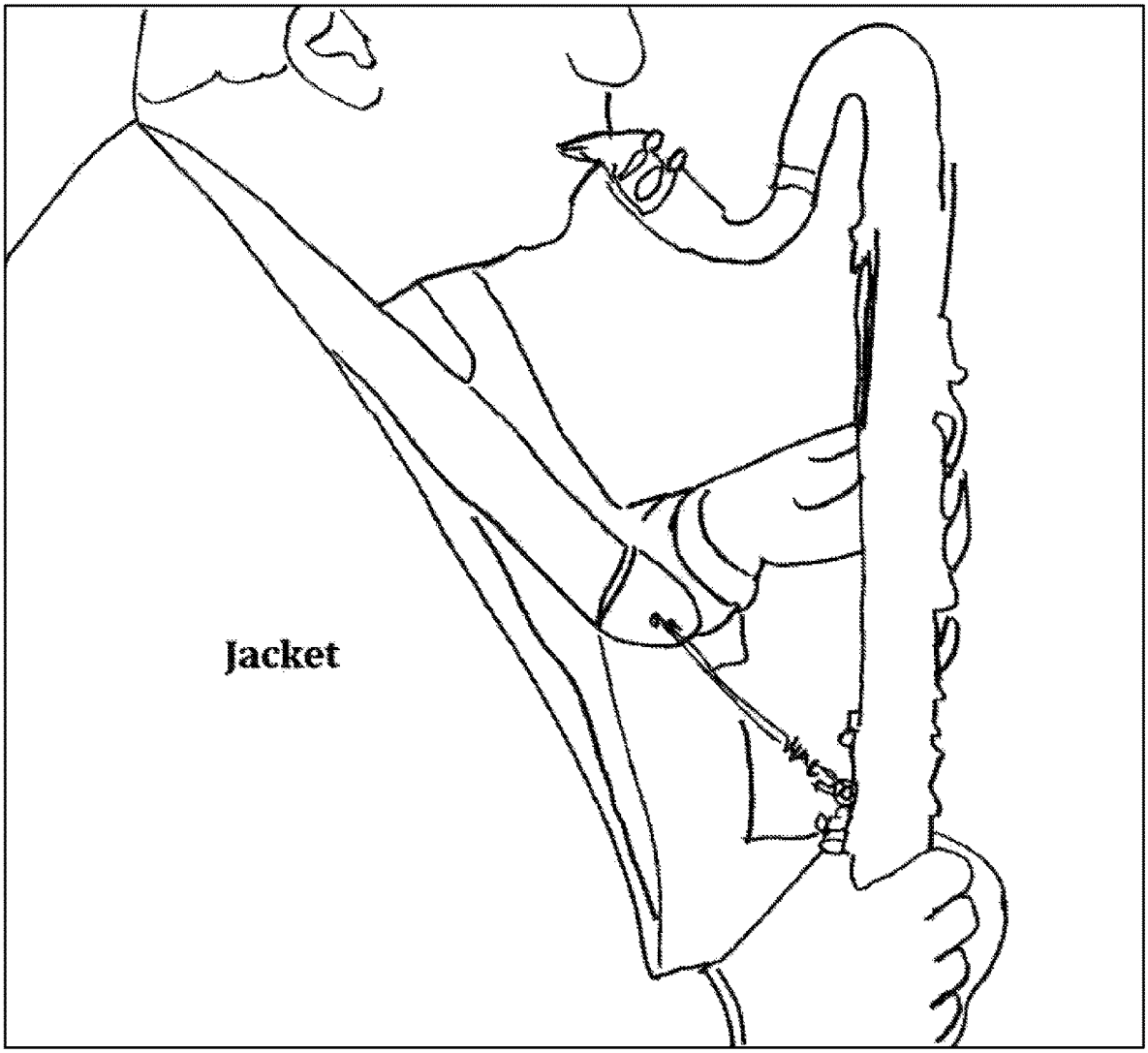
FIG. 15 illustrates the bass clarinet body strap, according to an embodiment of the present invention, being worn under a jacket.

Referring to FIG. 9-15, disclosed herein is a bass clarinet body strap assembly comprising a strap having a first end and a second end. Each end consists of an opening. The bass clarinet body strap further comprises a lace having two ends wherein one end of the lace connected to the second end of the strap. A hook is tied to other end of the lace and attached with an eye of the bass clarinet. The hook feeds through the first end of the wide strap end and is affixed to the eye of the bass clarinet. The strap goes in front of a bass clarinet player at chest level and extends over shoulder and across back of the bass clarinet player, and comes out below an opposite arm, and around front of the bass clarinet player to where the first end and the second end meet. The hook of the bass clarinet body strap assembly consists of two ends, wherein one end is a closed loop used for attachment by the lace, and another end is open so that it can hook onto the bass clarinet's eye attachment point that is built into the bass clarinet. The bass clarinet body strap assembly further comprises an adjustment buckle that can increase or decrease the length of the strap. The bass clarinet body strap assembly is provided with a reinforced material attached on the first end and the second end.

A Bb soprano clarinet in playing position. The clarinet is supported by the right thumb and the mouth on the mouthpiece and held at an angle of about 45 degrees. The weight of the instrument falls almost completely on the right thumb.

A soprano clarinet next to a bass clarinet, giving a perspective on the difference in size between the two instruments. A bass clarinet weights 15-25 times more than a soprano clarinet, and plays an octave lower than the soprano clarinet, although most of today's modern bass clarinets are extended to a low C rather than low E on the soprano clarinet.

The thumb rest on a soprano clarinet. The right thumb goes right below the thumb rest to hold up the weight of the instrument.

A right hand in playing position on the soprano clarinet. The right thumb is positioned below the thumb rest between the thumb nail and the first joint. The right thumb does not move while the instrument is being played, and the fingers of the right hand are left totally relaxed for effortlessly pressing the keys for great facility, rapidity, and fluidity.

The right hand in playing position on a bass clarinet. The thumb goes to the same position as it does when playing the soprano clarinet—between the right thumb nail and first joint—but does not support the weight of the instrument. This would be exceedingly difficult to do as a bass clarinet weights between 30-50 pounds. Identified in the photo are both the thumb rest and the loop attachment point used by the Bass Clarinet Body Strap or any other support mechanism.

A view of the bass clarinet lower joint, with the bass clarinet peg, which transmits the weight of the bass clarinet to the floor. The peg goes into an adjustable slot on the bass clarinet bell joint that has a tightening screw so that the player can adjust the height of the instrument up and down. A rubber foot at the bottom of the peg keeps the instrument from sliding.

The bass clarinet in playing position with no means of keeping the instrument from moving away from the player. The weight of the instrument is transmitted to the floor through the peg; therefore, the instrument is in a neutral position that is subject to outward pressure from the mouth and hands.

The bass clarinet being played with a neck strap that is connected to the loop attachment point above the right thumb rest. This appliance uses pressure from the neck to keep the instrument from moving away from the player. Because the strap goes around the neck, it pulls downward on the neck and can create pain, discomfort and stress on the neck, its muscles, and bones. The steep angle of this neck strap (>45 degrees) amplifies the downward pressure and creates additional discomfort.

The Bass Clarinet Body Strap assembly showing the end of the strap with the lace extending out to the hook that is fastened to the closed loop on the hook. It is being held in approximately the position where it will be used—at the bottom of the chest.

The wide strap of the Bass Clarinet Body Strap which goes over one shoulder.

The wide strap of the Bass Clarinet Body Strap which extends across the back, down around the other side of the back of the body.

The Bass Clarinet Body Strap positioned for use by a player. The hook is being held, ready to be attached to the bass clarinet loop attachment point. The lace attached at one end to the starting end of the wide strap, and the other end is attached to the hook. The hook and lace go through the far end of the wide strap, bringing them together. This way, tension from pulling the bass clarinet towards the player is distributed across the back instead of downward on the neck.

The hook of the Bass Clarinet Body Strap is hooked onto the bass clarinet loop attachment point, right above the thumb rest. In this position, the player is ready to play and stability and freedom are provided through the Bass Clarinet Body Strap.

The adjustment buckle on the wide strap of the Bass Clarinet Body Strap. This allows the wide strap length to be shortened or lengthened to allow for differences in player size and desired distance and pressure between the bass clarinet and the player.

Playing position with the Bass Clarinet Body Strap. It fits under a jacket or tuxedo.

The invention claimed is:

1. A bass clarinet body strap assembly comprising:

a strap having a first end and a second end, each end having an opening;

a lace having two ends, one end of the lace connected to the second end of the strap;

a hook tied to other end of the lace, the hook to be attached with an eye of a bass clarinet, the hook feeds through the first end of the wide strap end and is affixed to the eye of the bass clarinet;

wherein the strap goes in front of a bass clarinet player at chest level and extends over shoulder and across back of the bass clarinet player, and coming out below an opposite arm, and around front of the bass clarinet player to where the first end and the second end meet.

2. A bass clarinet body strap assembly of claim 1, further comprising an adjustment buckle that that can increase or decrease the length of the strap.

3. A bass clarinet body strap assembly of claim 1, wherein a reinforced material is attached on the first end and the second end.

4. A bass clarinet body strap assembly of claim 1, wherein the hook is having two ends, and wherein one end is a closed loop used for attachment by the lace, and another end is open so that it can hook onto the bass clarinet's eye attachment point that is built into the bass clarinet.

* * * * *